United States Patent [19]

Kuroyanagi et al.

[11] Patent Number: 4,950,845

[45] Date of Patent: Aug. 21, 1990

[54] SWITCHING DEVICE

[75] Inventors: Katsuya Kuroyanagi; Kazuhiro Kimura; Yoshitaka Itakura; Naotaka Hamada; Hiroyuki Mori, all of Aichi, Japan

[73] Assignee: Kojima Press Industry Co., Ltd., Aichi, Japan

[21] Appl. No.: 293,344

[22] Filed: Jan. 4, 1989

[30] Foreign Application Priority Data

Jan. 7, 1988 [JP] Japan ..... 63-1089[U]
Jan. 25, 1988 [JP] Japan ..... 63-8443[U]
Dec. 26, 1988 [JP] Japan ..... 63-167880[U]

[51] Int. Cl.[5] ..... H01H 9/26

[52] U.S. Cl. ..... 200/5 B; 200/5 E; 200/50 C

[58] Field of Search ..... 200/4, 5 R, 5 B, 5 C, 200/5 D, 5 E, 5 EA, 5 EB, 17 R, 18, 50 C

[56] References Cited

U.S. PATENT DOCUMENTS 4,383,147 5/1983 Raab et al. ..... 200/5 E X
4,517,422 5/1985 Black et al. ..... 200/5 E X
4,659,880 4/1987 Kondo et al. ..... 200/18 X

*Primary Examiner*—J. R. Scott
*Attorney, Agent, or Firm*—Koda & Androlia

[57] ABSTRACT

A switching device is disclosed in which a depression switch and a rotation/depression switch are interconnected by means of a coupling mechanism. When one of the knobs is turned ON, the remaining knob is automatically turned OFF. The switching device includes a depression knob projecting from a plate and disposed depressingly manipulatable; the depression switch for performing a predetermined switching operation in response to depressing operation of the depression knob; a rotation/depression knob provided on the plate and disposed rotatable and depressingly operable; the rotation/depression switch for performing a predetermined switching operation in cooperation with rotation or depressing movement of the rotation/depression knob; and, a coupling mechanism provided between the depression switch and the rotation/depression switch. The coupling mechanism releases a contact of one of the switches in response to ON operation of remaining one of the switch.

5 Claims, 10 Drawing Sheets

SWITCHING DEVICE

BACKGROUND OF THE INVENTION

The present invention relates to a switching device, and more particularly, to an improvement on the switching device for use in an air conditioning device installed in a vehicle, which device is capable of selectively providing an automatic control and a manual control.

A device such as an air conditioning device which requires a mode selection is provided with various switches. For example, in a vehicle, known are manual switches capable of setting predetermined hot or chilled air modes and setting blowing amount of the air blown from an air conditioning device, and an automatic switch which automatically controls such mode and blowing amount.

In FIG. 9, shown is a conventional switching device for use in an air conditioning device which switching device is assembled to an instrumental panel of a vehicle compartment.

In FIG. 9, mode switch group 2 and a fan switch 3 are provided on a plate 1. The mode switch group 2 includes a plurality of depression switch buttons each for setting various hot air or chilled air blowing directions, and the fan switch 3 is of slidable type for setting blowing amount of air. An auto mode switch 2*a* is provided for automatically controlling air blowing direction upon depression thereof. Further, the fan switch 3 has a knob 3*a* which is slidably movable. When the knob 3*a* is slidingly brought to a position "AUTO", air blowing amount is automatically controlled in accordance with changes in various air conditions at internal and external portions of the vehicle compartment.

FIG. 10 shows another example showing a conventional switching device for use in the air conditioning device. According to this device, mode switch group 2 and the blower switch group 4 are both constructed by push-type buttons, and a common auto switch 5 is provided between the switch groups 2 and 4.

With the latter structure, when the air blowing direction and the air blowing amount are to be set by an operator's demand, one of the buttons of mode switch group 2 and one of the buttons of the fan switch group 4 are depressed independent of each other, similar to the first-described conventional device shown in FIG. 9. However, when the blowing direction and the blowing amount of the air are both required to be set in an automatic mode, only the auto switch 5 is depressed to obtain a full-automatic state, to thereby simplify manipulation.

In the conventional device shown in FIG. 9, the fan switch 3 is of slidable type, and therefore, the switch does not occupy large space. However, when the both blowing direction and blowing amount of the air are to be controlled automatically, both switches must be manipulated to be ON independently of each other, and therefore, intricate manipulation is required and such intricacy may degrade vehicle drivability.

Further, since the mode switch group 2 and the blow switch group 4 are both in the form of depression switches independent of one another and these must be aligned in a single array in an identical plane, these groups occupy greater space in the instrumental panel. Therefore, compact switching device may not be obtainable.

Furthermore, according to the lever or button type structure shown in FIGS. 9 and 10, it would be difficult to perform fine control to the air blowing amount with the lever or button and accordingly, it would be impossible to promptly obtain optimum air conditioning state within the vehicle compartment.

The above described drawbacks are also recognized in the household electric equipment and audio equipment those being provided with various manipulation switches for switching and/or selecting various functions in accordance with recent demand in equipment having multi-functions.

SUMMARY OF THE INVENTION

The present invention is accomplished in order to overcome the above-described drawbacks, and therefore, it is an object of this invention to provide a switching mechanism which is capable of providing a desired function only by a single ON operation, and promptly switching toward another function and which is compact in size with producing at low cost yet facilitating fine control to air blowing direction, air blowing amount or any functional matters attendant to air conditioning device installed in a vehicle, household electrical equipments and audio equipments.

In order to attain these and other objects, in accordance with a first aspect of this invention there is provided a switching device comprising;

- a depression knob projecting from a plate and disposed depressingly manipulatable;
- a depression switch for performing a predetermined switching operation in response to depressing operation of the depression knob;
- a rotation/depression knob provided on the plate and disposed rotatable and depressingly operable;
- a rotation/depression switch for performing a predetermined switching operation in cooperation with rotation or depressing movement of the rotation/-depression knob: and,
- a coupling mechanism provided between the depression switch and the rotation/depression switch. The coupling mechanism releases an ON-state locking of one of the switches in response to ON operation of remaining one of the switch.

According to a second aspect of this invention, the coupling mechanism according to the invention is constructed in a link mechanism. The link mechanism is provided between the depression switch and the rotation/depression switch. The link mechanism releases an ON-state locking of the rotation/depression switches in accordance with depressing movement of the depression knob, and the link mechanism permits the depression switch to be restored to OFF state in accordance with rotation or depression of the rotation/depression knob.

According to a third aspect of this invention, the depression knob corresponding to that of the first aspect of this invention is provided with a shaft portion whose side wall is formed with a locking step, and the rotation/ depression knob corresponding to that of the first aspect of this invention is provided with a shaft portion whose outer peripheral portion has a conical shape and provided with gear teeth. Further, the association mechanism includes a coupling plate member slidably disposed between the depression knob and the rotation/depression knob. The coupling plate has one end provided with a pawl or cam portion which is engageable with the gear teeth portion of the shaft of the rotation/depression knob, and having another end formed with a looking portion engageable with the locking step of the shaft portion of the depression knob.

According to a fourth aspect of this invention, the coupling mechanism corresponding to the first aspect of this invention includes a release switch which provides OFF state with respect to the depression switch upon ON operation of the release switch; a central shaft connected to the rotation/depression switch knob; and, a release plate having one end fixed to the central shaft and another end provided abutable with the release switch for transmitting depressing movement of the rotation/depression switch knob and turning ON the release switch.

In accordance with the first aspect of this invention, since the depression switch and the rotation/depression switch are interconnected by means of the coupling mechanism, when one of the knobs is turned ON, the remaining knob is automatically turned OFF.

Further, in accordance with the second aspect of this invention, for setting one desirable function, only the depression knob is to be depressed. If another function is intended, the rotation/depression knob is depressed or rotated.

Take an air conditioning device installed in a vehicle for instance, the depression knob for automatic control is only manipulated in order to obtain full automatic state. That is, the depression knob for the automatic control is connected to two automatic switches, and one of the switches is cooperated with a manual switch by means of the link mechanism. Upon depressing movement of the automatic control depression knob, this depression movement is simultaneously transmitted to the manual control switch through the link mechanism, so that a contact of the manual switch is released.

Therefore, for providing the full-automatic state, it is unnecessary to manipulate the manual control knob. In other words, ON operation with respect to the automatic switch and OFF operation with respect to the manual switch are simultaneously performable only by the depressing operation with respect to the depression knob for the automatic control.

When, the switching from the full-automatic state to the manual control state is intended, a contact of the manual control switch is released by rotating or depressing the manual control knob, and at the same time, the movement of the manual control knob is transmitted to the automatic control switch through the link mechanism, so that the automatic control switch is restored to its OFF position.

Further, in accordance with the third aspect of this invention, the depression knob and the rotation/depression knob are directly cooperable by means of the coupling plate. Therefore, synchronous ON/OFF operations relative to the pair of switches are attainable with such simple construction in highly accurate manner.

That is, upon rotation or depression of the rotation/-depression knob, the pawl or cam portion of the coupling plate, which pawl or cam has been engaged with the conical gear provided at the outer peripheral surface of the shaft of the rotation/depression knob, will be pushed away by the ridge portion of the gear or by the conically stanting surface thereof. As a result, the locking step formed at the depression knob is moved away from the locking portion of the coupling plate, to thereby restore OFF position. This embodiment requires reduced numbers of mechanical components for interconnecting the knobs, and reliable coupling movement is achievable.

Furthermore, in accordance with the fourth aspect of this invention, when the rotation/depression knob is depressed, the release plate fixed to the central shaft connected to this knob is displaced concurrent with the depressing movement of the depression knob. And the tip end portion of the release plate is brought into abutment with the release switch, so that the release switch is turned ON.

BRIEF DESCRIPTION OF THE DRAWINGS

In the drawings;

FIGS. 7A-1, 7A-2, 7B, 7C-1, 7C-2, 8A, 8B and 8C are views for description of operation with respect to the device shown in FIG. 6;

DETAILED DESCRIPTION OF THE PREFERRED EMBODIMENTS

Preferred embodiments according to the present invention will be described with reference to the accompanying drawings.

Figure 1:
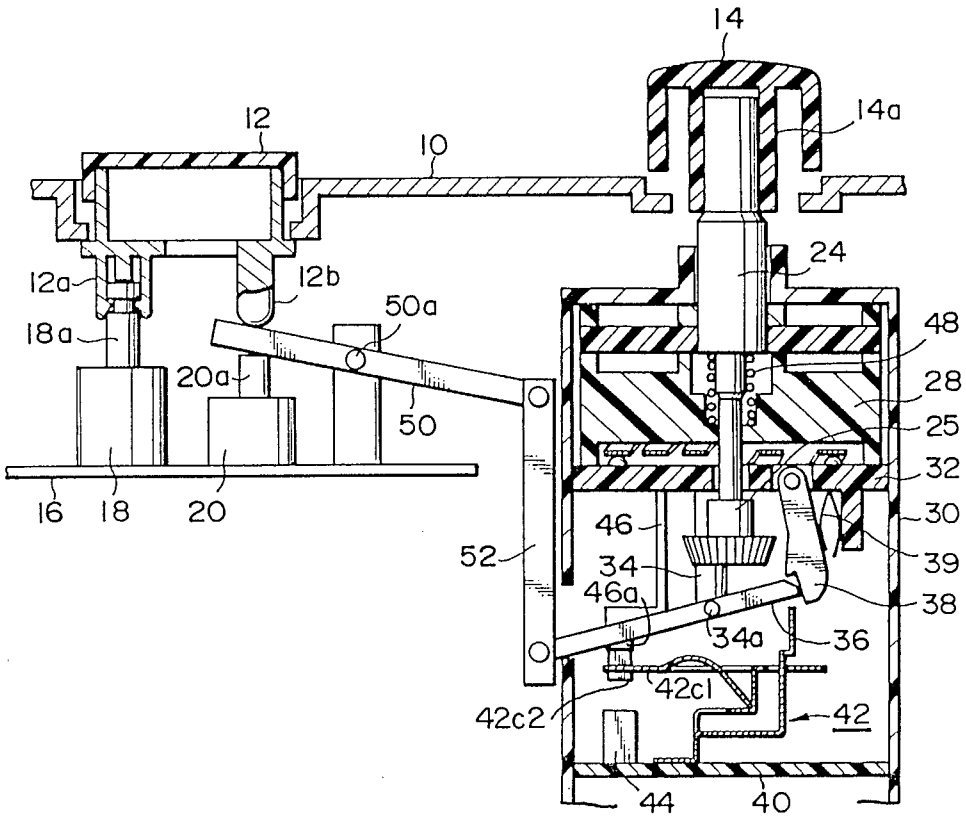
FIGS. 1 and 2 are cross-sectional views showing a switching device according to this invention which is applied to an air conditioning device installed in a vehicle.

FIG. 1 is a cross-sectional view showing a principle structure of a switching device according to this invention.

In FIG. 1, a plate 10 is provided with a depression knob 12 for automatic control and a rotation/depression knob 14 for manual control, these knobs being protrudingly disposed from the plate and spaced away from each other.

Below the automatic control depression knob 12, there are provided a projecting portion **12*a* and a pawl portion 12*b* integral therewith and projecting downwardly. The projecting portion 12*a* and the pawl portion 12*b* are adapted to directly depress movable portions 18*a* and 20*a*, respectively, of an auto mode switch 18 and an auto blow switch 20**, respectively.

On the other hand, a sleeve portion **14*a* is provided at a central portion of the manual control rotation/depression knob 14, and a shaft 24 is in fitting engagement with an inner peripheral surface of the sleeve portion 14*a*. The shaft 24 is provided with a rotor 28 rotatable together with the rotation of the shaft 24, and is integrally provided with a gear 25 whose conical portion is engraved with gear teeth. These are accommodated within a switch case 30** for the manual control.

Within the manual control switch case 30, a support portion 34 extends from a lower surface of a retainer 32 disposed below the rotor 28. The support portion 34 has an axis **34*a* about which a switching rod 36** is pivotably provided.

The bottom surface of the rotor 28 and the top surface of the retainer 32 are provided with movable contacts and stable contacts, respectively. When automatic state of the auto blower switch 20 is released, (that is, when the switch becomes its manual operational state), these contacts are in contact with each other upon rotation of the manual control rotation/-depression knob 14, to thereby vary the air blowing amount.

Further, a locking piece 38 is pivotally connected to the retainer 32. The locking piece 38 is engageable with the gear 25, and is adapted to hold the switching rod 36 at a given fixed position. The locking piece 38 is normally urged in a clockwise direction by a biasing force of a spring 39.

The retainer 32 has a sub retainer 40 which defines a bottom wall of the case, and a receiving portion 44 for receiving the manual switch plate 42 and a contact thereof is fixedly mounted on an upper surface of the sub retainer 40. Further, a plate 46 is provided which is directed downwardly from the retainer 32 for contacting with the contact of the manual control switch plate 42.

Between the shaft 24 and the rotor 28, a coil spring 48 is interposed. The coil spring 48 urges the shaft 24 toward a direction to restore its original position when the manual control rotation/depression switch knob 14 is depressed to forcibly move the shaft 24 downwardly.

One feature of this invention resides in a provision of a link mechanism which transmits switch movement upon operation of one of the auto switch and the manual switch from one side the other. When one of the switches is turned ON, this movement is transmitted to the remaining switch by way of the link mechanism, so that the latter is controlled to be OFF. As a result, only by a single operation of one of the switches, one of the switches is turned ON, and remaining switch is concurrently turned OFF.

Figure 2:
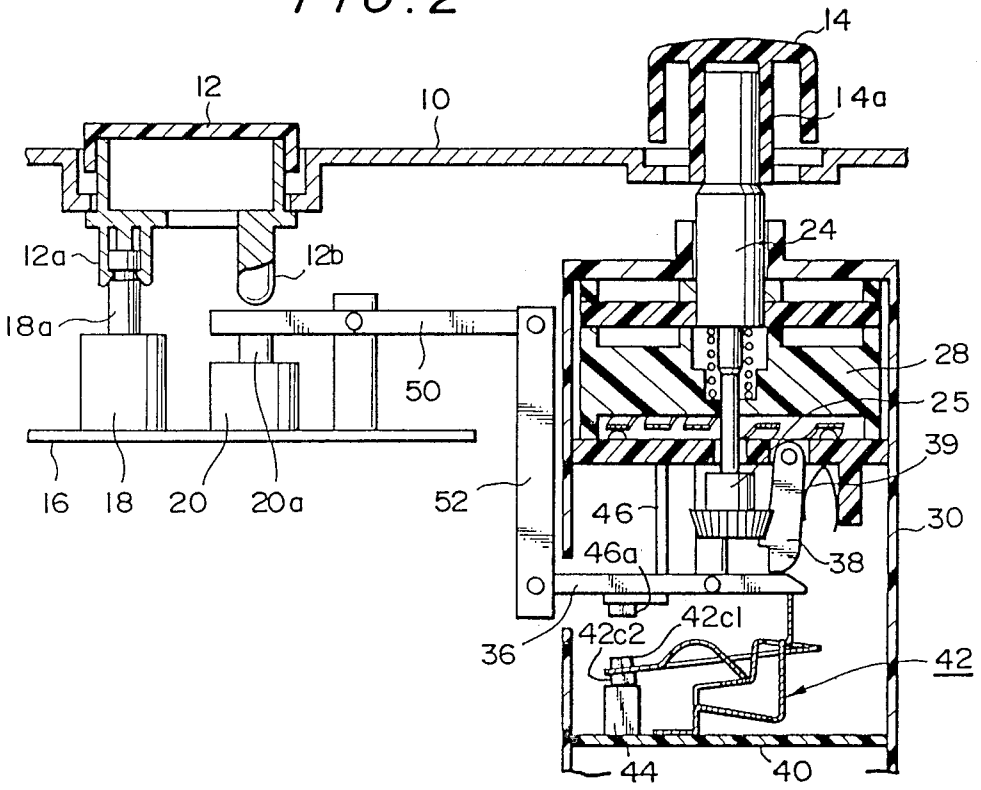
Figure 3:
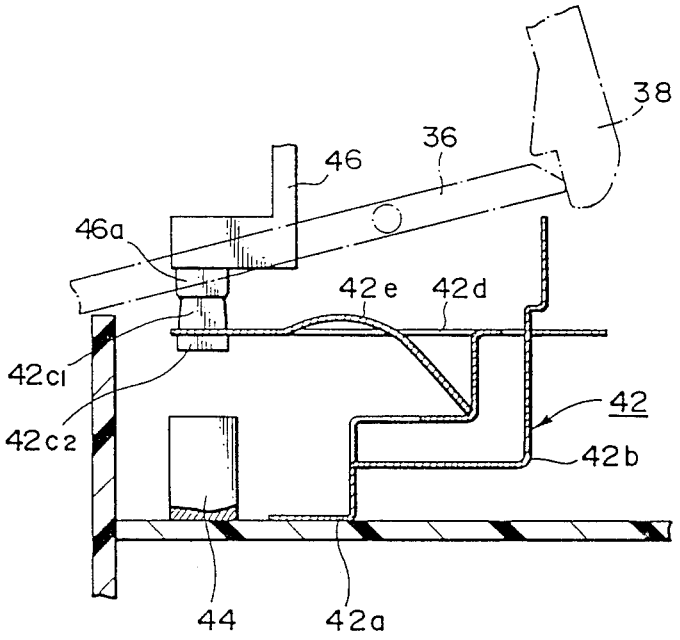
FIG. 3 is an enlarged view showing a manual control switch shown in FIGS. 1 and 2.

FIG. 3 is an enlarged view showing the manual control switch plate 42 shown in FIGS. 1 and 2. The manual control switch plate 42 includes a mounting member **42*a* fixed to the sub retainer 40 at the bottom of the manual switch case 30, a biasing member 42*b* fixed to the mounting member 42*a*, and a swinging member 42*d* connected to the mounting and biasing members 42*a* and 42*b*** and having an end portion provided with contacts $42c_1$ and $42c_2$.

A spring member **42*e* is latched between the mounting member 42*a* and the swinging member 42*d*. These members 42*a* thru 42*e* in the manual control switch plate 42 is formed of resilient material, and are freely movable except a lower surface of the mounting member 42*a*, which lower surface is fixed to the sub retainer 40. By an operation described later, the contact 42*c* of the switch plate 42 is coming into contact with a contact 46*a* of a plate 46 or the receiving portion 44 upon abutment of the switching rod 36 with an upper end of the biasing member 42*b*. The plate 46 is in contact with contacts of the retainer 32**.

Function attendant to the first embodiment will next be described.

Figure 4A:
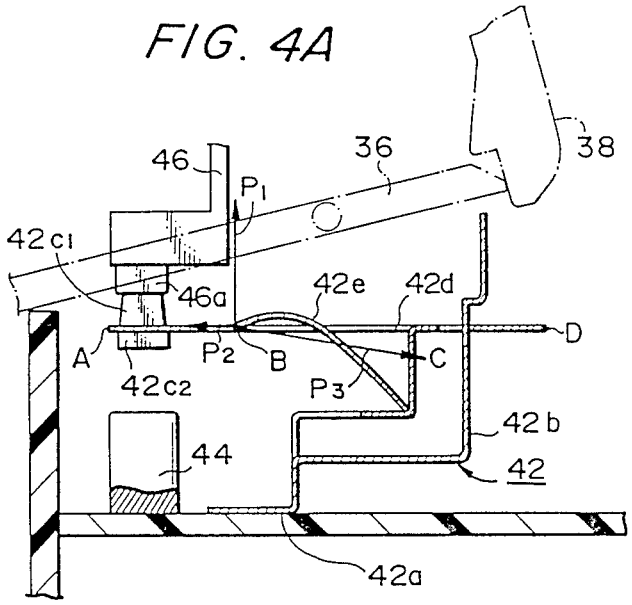
FIGS. 4A and 4B are views for description of the manual control switch according to the present invention.
Figure 4B:
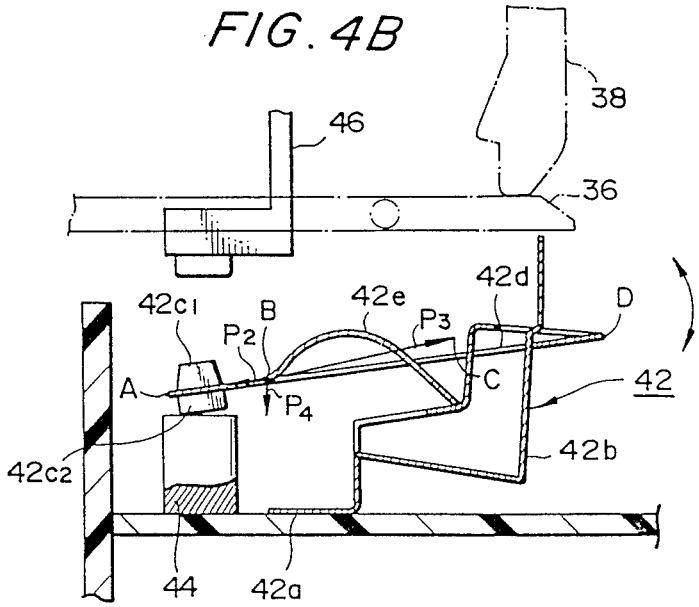

FIG. 1 shows the manual control state in which the manual control rotation/depression knob 14 is turned ON, and FIG. 4 shows an enlarged view showing the manual control switch plate 42 and its ambient portion.

In this ON state of the manual control switch plate 42, the spring member **42*e* is imparted with a biasing force $P_3$, so that horizontal force $P_2$ and vertical force $P_1$ are applied with respect to the swinging member 42*d*, to thereby maintain the geometrical position shown in FIG. 1**.

When the automatic control depression knob 12 is depressed, the projecting portion **12*a* and the pawl portion 12*b* those provided integral with the knob 12 respectively urge the movable portions 18*a* and 20*a* of the auto mode switch 18 and the auto blower switch 20** to provide ON state, so that the two auto switches are simultaneously turned ON by the single switching operation.

In this instance, left end portion of the first link 50 mounted on the movable portion **20*a* of the auto blower switch 20 is simultaneously moved downwardly, so that the first link 50 is moved in counterclockwise direction about the axis 50*a*. Therefore, a second link 52 connected to the right end portion of the first link 50** is moved upwardly.

Therefore, the left end portion of the switching rod 36 connected to the lower end portion of the second link 52 is moved upwardly, and the right end portion of the rod 36 is moved downwardly. By the downward movement of the right end portion of the rod 36, the lower surface of the right end portion of the switching rod 36 is brought into abutment with the upper end portion of the swinging member **42*d* of the manual control switch plate 42 fixedly mounted on the sub retainer 40. As a result, the swinging member 42*d* is depressed downwardly. With this movement, the biasing direction of the spring 42*e* interposed between the swinging member 42*d* and the mounting member 42*a* of the manual control switch plate 42 is changed. Accordingly, the contact 42*c* which has been in abutment with the plate 46 will subjected to force to a direction in which the contact 42*c* will be in abutment, with the receiving portion 44 fixedly mounted on the sub retainer 40**.

Figures 5A, 5B, 5C:
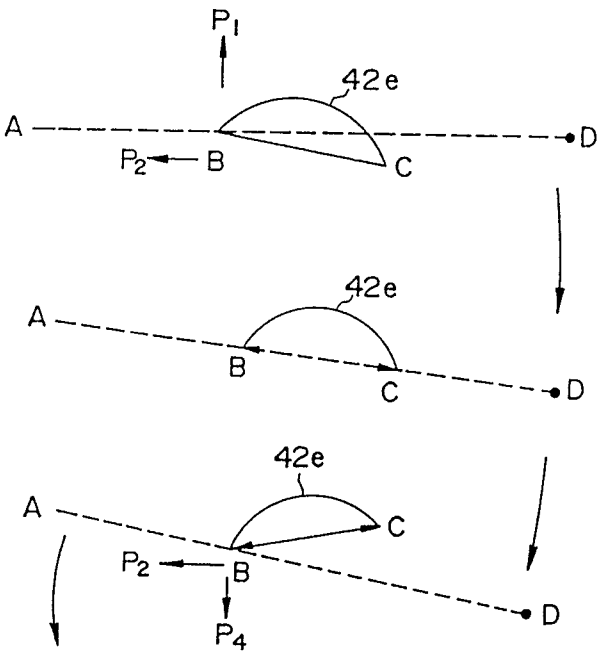
FIGS. 5A, 5B and 5C are views for description of a spring for use in the manual control switch according to this invention.

In a state shown in FIGS. 1, 4(A) and 5(A), the biasing direction of the spring member **42*e* can be maintained unchanged so long as an operational point C of the spring member 42*e* is lower side from the line connecting the end point A of the swinging member 42*d* and other end of the member 42*d* through the root point B of the spring member 42*e***.

When the movement of the switching rod 36 in the clockwise direction is further progressed for further moving the biasing member **42*b* downwardly, the line-through points A, B and D are displaced to lower from the point C as shown in FIG. 5(B), the force $P_1$ which has been directed upwardly in vertical direction will be converted into a force $P_4$ directed downwardly in vertical direction as shown in FIG. 5(C). Therefore, the swinging member 42*d* is moved in counterclockwise direction, so that the contact $42c_2$ provided at the tip end portion thereof is brought into abutment with the receiving portion 44**.

Thus, the contact of the manual control switch plate 42 is released to provide OFF state.

Therefore, according to the present invention, both the automatic mode switch 18 and the auto blower switch 20 are simultaneously controlled to be ON upon depression of the automatic control depression knob 12, and at the same time, the manual control switch plate 42 which has been maintained in ON state will be controlled to be OFF.

Next, described below is the switching or change over function from full automatic state to the manual control state.

In the present invention, the manual control rotation/depression knob 14 is in a form of a dial type switch knob which is rotatably provided. The knob is also depressingly operable, so that the switching operation from full automatic state to the manual control state can be made by either one of the rotation and depression of the manual control rotation/depression knob. For shifting the full automatic state to the manual control state, when rotating the manual control rotation/-depression knob 14, the gear 25 fixed to the tip end portion of the shaft 28 fitted with the knob 14 is also rotated. In this case, the locking piece 38 is moved in counterclockwise direction by the biasing force of the spring 39 with the locking piece 38 being clickingly slidable on a conically slanting surface of the gear teeth portion, so that the locking piece 38 is disengaged from the gear 25. Simultaneously, the switching rod 36 is disengaged from the locking piece 38, and the right end portion of the switching rod 36 is urged upwardly by the biasing force accumulated in the manual control switch plate 42, and is moved in counterclockwise direction.

In this case, the contact $42c_1$ of the manual control switch is in abutment with the projecting portion 46*a* of the plate 46, so that manual operation mechanism is attainable.

Concurrently, the second link 52 connected to the switching rod 36 is moved downwardly by the downward pivotal movement of the left end portion of the switching rod 36. Further, the left end portion of the first link 50 connected to the second link 52 is pivotally moved upwardly about the axis 50*a*. With this movement, the pawl portion 12*b* of the automatic control depression knob 12 is urged upwardly to thereby restore original position of the auto mode switch 18 and the auto blower switch 20.

As described above, the manual control rotation/-depression knob 14 is provided depressingly operable in accordance with the present invention. Therefore, shifting from the full-automatic state to the manual control state can also be made by the depressing operation of the knob 14. In the latter case, when the manual control rotation/depression knob 14 is depressed against the biasing force of the coil spring 48, the gear 25 provided at the tip end, of the shaft 24 is moved downwardly, so that the switching rod 36 is disengaged from the gear 25, to thereby pivotally move the switching rod 36 in counterclockwise direction by the biasing force of the manual control switch plate 42. Thereafter, shifting to the manual control is effected in the manner similar to that in the rotational operation of the knob 14.

Next, another embodiment according to the present invention will be described with respect to FIGS. 6A thru 8C. Central feature in the second embodiment resides in approximately direct connection between the both switch knobs with reduced numbers of mechanical components by means of a cam locking mechanism which makes use of a slant surface, ridge portions and valley portions of a conical gear.

Similar to the first embodiment, the second embodiment exhibits an effect similar to that attainable in the first embodiment. When one of the switch knobs is turned ON, the remaining switch knob is simultaneously and automatically turned OFF.

Figure 6A:
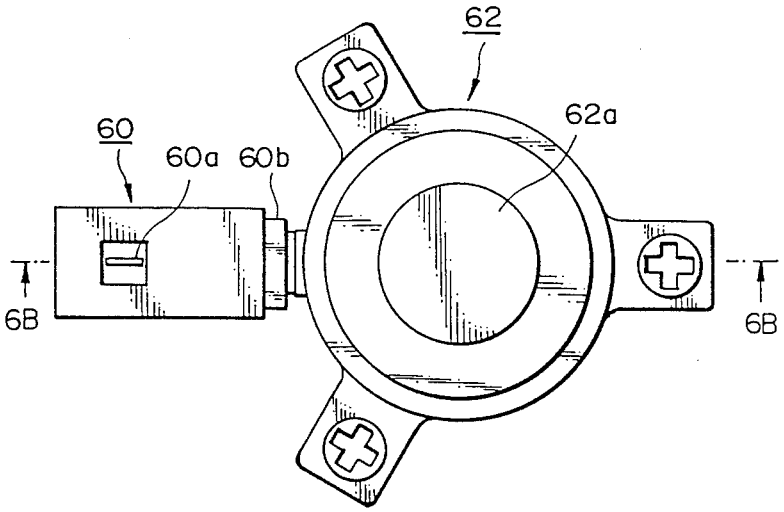
FIGS. 6A, 6B and 6C are views showing a structure of a switching device according to a second embodiment of this invention.
Figure 6B:
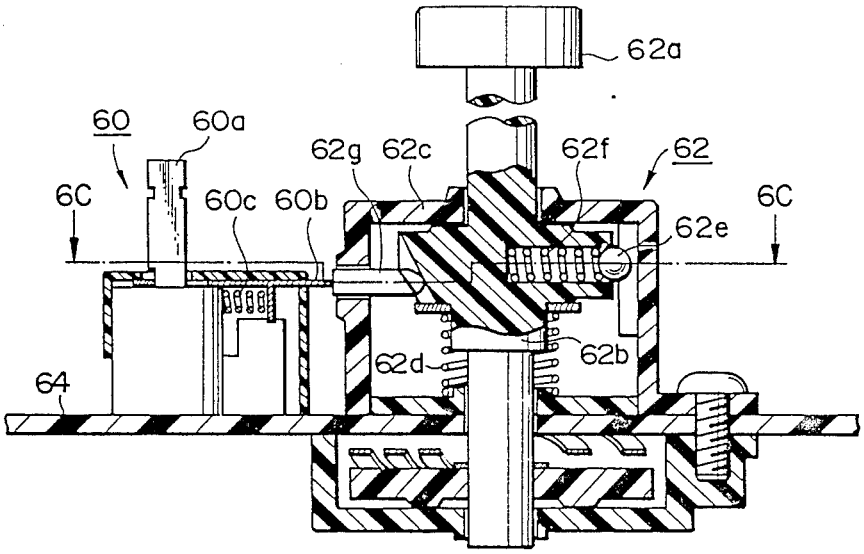
Figure 6C:
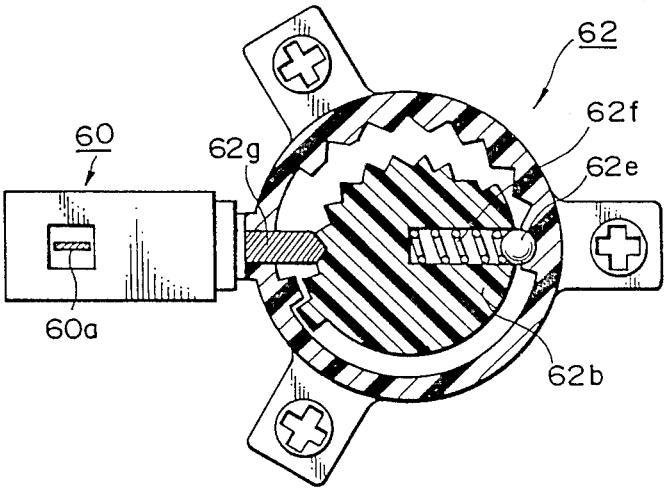

FIG. 6(A) is a front view showing a switching device according to the second embodiment. FIG. 6(B) is a cross-sectional view taken along the line 6B—6B in FIG. 6(A), and FIG. 6(C) is a cross-sectional view taken along the line 6C—6C of FIG. 6(B). In these drawings, a depression switch 60 having a protruding depression knob 60*a* and a rotation/depression switch 62 having a rotation/depression switch knob 62*a* which is provided rotatable and depressingly operable are assembled on a plate 64 formed of a printing board.

The rotation/depression switch knob 62*a* is integrally provided with a shaft 62*b* which is accommodated within a rotation/depression switch case 62*c*. A spring 62*d* is disposed over an outer peripheral surface of the shaft 62*b*, so that the shaft is urged upwardly in FIG. 6(B).

As is apparent from FIG. 6(C), the shaft has an outer peripheral portion formed with a gear teeth, and a spring 62*f* is fixedly embedded at a side wall, so that a ball 62*e* is urged toward an inner peripheral surface of the case 62*c*. On the other hand, at the lower end of the depression switch knob 60*a*, a locking plate 60*b* is urged rightwardly in the drawing by a biasing force of a locking spring 60*c*.

The locking plate 60*b* has a tip end fixed with a cam 62*g* which extends through the case 62*c* of the rotation/-depression switch 62 and is engageable with the gear of the shaft 62*b*. As will be described later, the combination of the locking plate 60*b*, the locking spring 60*c*, the cam 62*g* and the gear at the outer peripheral surface of the shaft 62*b* serves as coupling mechanism between the switches 60 and 62.

In this embodiment, by a single depressing operation to the depression switch 60, automatic control mode is provided with respect to both air blowing direction and air blowing amount. On the other hand, by the rotation or depressing operation of the rotation/depression switch 62, the automatic control mode will be converted into a manual control mode. Also, in this embodiment, the depression switch 60 and the rotation/-depression switch 62 are mutually associated with each other in terms of ON/OFF operations. That is, upon ON/OFF operation to the one of the switches 60 and 62, the remaining one of the switches 62 and 60 is simultaneously controlled to be OFF/ON, so that in the air conditioning device switching operation between automatic control and manual control can be effected by a single operation. Further, since the rotation/depression switch 62 which is the manual control switch controls the air blowing amount by the rotation of the knob 62, fine control to the air blowing amount is facilitated and optimum air conditioning state is promptly obtainable, which fine control has been troublesome by the conventional depression type or slide lever type switch.

Further, in the second embodiment, as is apparent from the drawings the coupling mechanism between the depression switch 60 and the rotation/depression switch 62 is of simple structure requiring minimized numbers of mechanical components. Therefore, high productivity and assemblability result, to thereby lower production cost.

Next, operation mode according to the second embodiment will be described.

Shown in FIG. 7(A1), 7(A2), 7B, 7(C1) and 7(C2) is a schematic illustration showing an essential portion of the association mechanism between the depression switch 60 and the rotation/depression switch 62. Further, the operational relationship between the depression switch knob 6O*a* and the locking plate 60*b* is shown in FIGS. 8A–8C. FIGS. 7(A1) and 7(A2) show the interconnection between the switches 60 and 62 when the air conditioning device is settled in the automatic control mode by the depression to the depression switch 60.

When the depression switch knob 60a is depressedly moved from a position shown by a chain line to a solid line in FIG. 7(A2), the locking plate 60b is pushedly moved rightwardly in the drawing against the biasing force of the locking spring 60c. As a result, the cam 62g connected to the locking plate 60b is brought into engagement with the gear provided at the outer peripheral surface of the shaft 62b of the rotation/depression switch 62.

In this case, starting from the state shown in FIG. 8(A), when he depression switch knob 60a is completely depressed, a locking notch 60a1 formed at a side portion of the switch knob 60a is brought into engagement with a recessed portion 60b1 formed at the locking plate 60b as shown in FIG. 8(B). As a result, lateral position of the locking plate 60b is held unchanged by a biasing force of a spring (not shown) which urges the depression switch knob 60a upwardly in FIG. 8(B). Accordingly, the cam 62g is maintainingly engaged with the valley portion of the gear of the shaft 62b. Thus, the automatic control mode is established, so that air blowing amount and air blowing direction are optimumly automatically controlled in accordance with conditions inside and outside the vehicle compartment.

Figures 1, 7A:
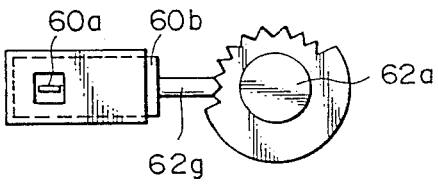
Figures 2, 7A:
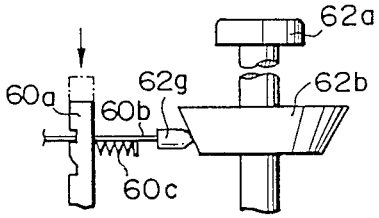
Figure 7B:
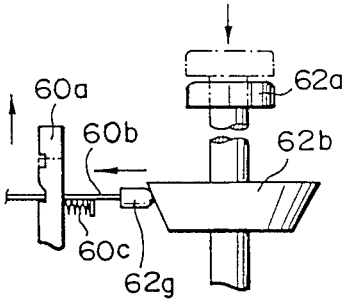
Figures 1, 7C:
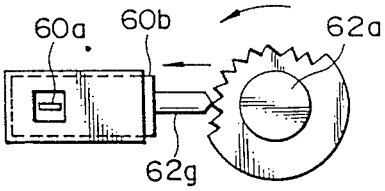
Figures 2, 7C:
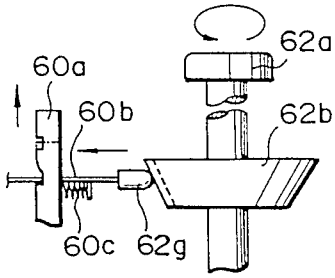
Figure 8A:
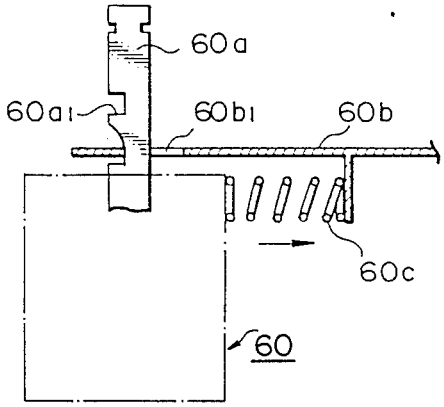
Figure 8B:
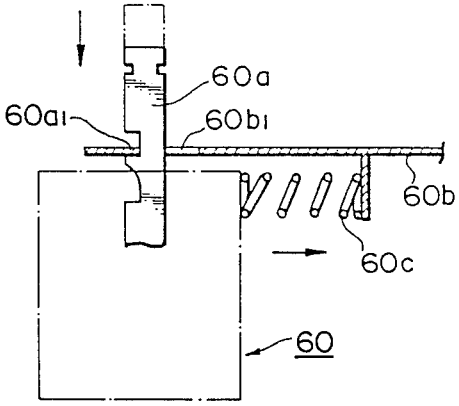
Figure 8C:
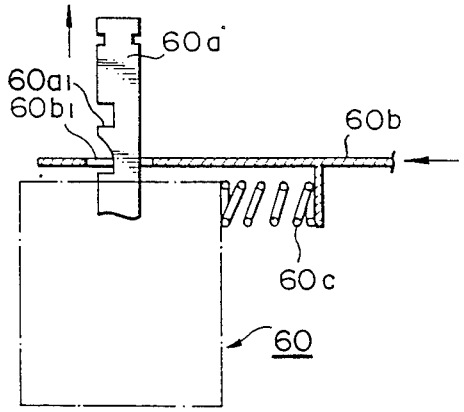
Figure 9:
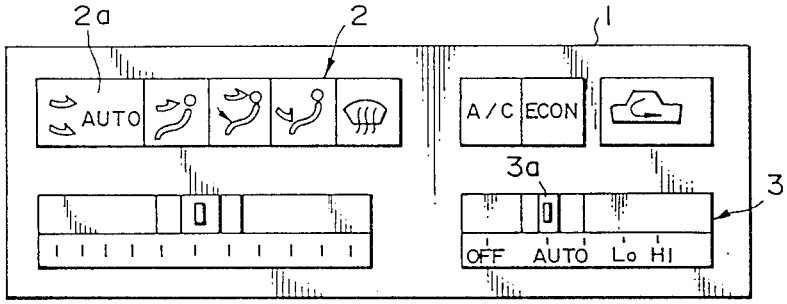
FIG. 9 PRIOR ART
FIGS. 9 and 10 are views showing external appearances in conventional switching devices.
Figure 10:
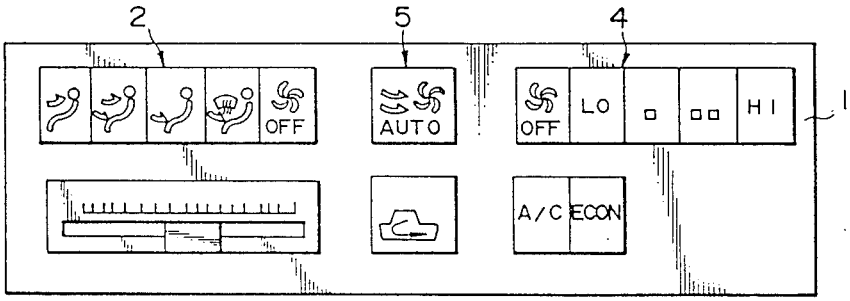
FIG. 10 PRIOR ART

Starting from the automatic control state, when the rotation/depression switch knob 62a is depressed or rotated as shown in FIGS. 7(B), 7(C1) and 7(C2), the cam 62g shown in FIG. 7(A1) and 7(A2) is disengaged from the gear of the shaft 62b, so that the locking plate 60b is slidingly moved leftwardly to restore its original position. At the same time, the depression switch knob 60a is returned to a position shown by the chain line, to thereby release automatic control state and provide the manual control mode.

That is, as shown in FIG. 7(B), when the rotation/-depression switch knob 62 is depressed, the shaft 62b is moved downwardly so that the cam 62g is pushedly moved leftwardly as indicated by an arrow, since the gear provided at the outer peripheral surface of the shaft 62b is in a form of an inverted frusto-conical shape. Therefore, the tip end of the cam 62g is spaced away from the gear to disengage therefrom.

Simultaneously, the locking plate 60b is moved leftwardly in FIG. 8(C), so that the recessed portion 60b of the locking plate 60b is disengaged from the notched portion 60a1 of the depression switch knob 60a. Accordingly, the depression switch knob 60a is moved upwardly because of the biasing force of the spring (not shown), to thereby release automatic control state. With such operation, interconnection between the depression switch 60 and the rotation/depression switch 62 is released by the leftward movement of the cam 62g. Therefore, the rotation/depression switch knob 62a restores its original position by the biasing force of the spring 62d, so that the rotation/depression switch knob can undergo manual rotation control.

FIGS. 7(C1) and 7(C2) shows another operation in which the automatic control mode is converted into the manual control mode not by the depression to the rotation/depression switch knob 62a but by rotating the same. When the rotation/depression switch knob 62a is rotated to either one direction, the shaft 62b is also rotated about its axis, so that positional relationship relative to the cam 62g which has been fixedly positioned and associated with the depression switch 60 is changed. As a result, the tip end of the cam 62g which has been fitted with the valley portion of the shaft 62b will ride over the ridge portion of the gear. By this riding over operation of the cam, the cam 62g together with the locking plate 62b are pushed leftwardly in the drawing, and the cam is disengaged from the gear similar to the above-described depressing operation. As a result, the depression switch knob 60a moves upwardly to restore its original position.

As described above, according to the second embodiment of this invention, the depression switch knob 60a is automatically controlled into reversed state by the manipulation of the rotation/depression switch knob 62a. Substantial mechanical association between these switches 60 and 62 can be stabilizingly provided by the minimized numbers of the mechanical components such as the locking plate 60b, the locking spring 60c and the cam 62g. Therefore, switching operation between the automatic control and the manual control can be effected with simple construction and high reliability.

The above description concerns a case where the present invention is applied to the air conditioning device installed in the vehicle compartment. However, the present invention is not limited to this case, but the invention is also available to the household electrical equipments and audio equipment.

As described above, according to the present invention, the switches having functions different from each other are cooperably movable by means of the link mechanism, and ON operation to one of the switches simultaneously provides OFF state with respect to the remaining switch. Therefore, prompt and stabilized switching operation is attainable only by the mechanical associating mechanism having simple construction.

Further, since one of the switches is in the form of the dial type switch which is rotatable and depressable, the component on the instrument panel does not occupy great space, to thereby render the switching device compact in terms of spacial efficiency.

Furthermore, since one pair of the switch knobs are cooperably movable by means of the coupling plate only, stable cooperational movement is attainable with a reduced numbers of the mechanical components.

Moreover, since the rotation/depression switch knob also serves as the air blowing amount controlling knob, stabilized operability is attainable, and fine control is facilitated by controlling the knob.

What is claimed is:

1. A switching device comprising:

a depression knob projecting from a plate and manipulated by a depressing operation;

a depression switch for turning on in response to depressing operation of said depression knob;

a rotation/depression knob provided on said plate, said rotation/depression knob being operable by rotation and depressing movement;

a rotation/depression switch for turning on in response to rotation or depressing movement of said rotation/depression knob; and, a coupling mechanism between and for operating both said depression switch and said rotation/-depression switch such that when one of said depression switch and said rotation/depression switch is turned ON by operation of one of said depression knob and said rotation/depression knob, the other of said depression switch and said rotation/depression switch is turned OFF.

2. A switching device comprising:

a depression knob projecting from a plate and manipulated by a depression operation;

a depression switch for being turning on in response to depressing operation of said depression knob;

a rotation/depression knob provided on said plate being operable by depressing and rotation movements;

a rotation depression switch for being turned on in response to rotation or depressing movement of said rotation/depression knob; and, a link mechanism coupled between and for operating both said depression switch and said rotation/-depression switch such that when one of said depression switch and said rotation/depression switch is turned ON by operation of one of said depression knob and said rotation/depression knob, the other of said depression switch and said rotation/depression switch is turned OFF.

3. A switching device comprising:

a depression knob projecting from a plate and manipulated by depressing operation;

a depression switch for being turning on in response to depressing operation of said depression knob;

a rotation/depression knob provided on said plate being operable by depressing and rotation movement;

a rotation/depression switch for being turned on in response to rotation or depressing movement of said rotation/depression knob; and, a gear shaft fixed to and for rotation with said depression knob and having an outer peripheral portion formed with gear teach and having a conical shape;

a switching rod swingably disposed within said rotation depression switch and coupled to said depression switch through a link mechanism;

a lock disposed within said rotation/depression switch engagable with said gear shaft, which holds said switching rod at a position when said depression switch turns ON;

a bias spring for biasing said switching rod in the locking direction;

wherein said rotation/depression switch is operated to turn OFF upon said depression knob being depressed, and said depression switch interlockingly returns to the OFF-state upon said rotation/-depression switch being rotated or depressed.

4. A switch device comprising:

a depression knob disposed on a plate and manipulated by depressing operation, said depression knob having a side wall formed with a locking step;

a depression switch for being turning on in response to depressing operation of said depression knob;

a rotation/depression knob disposed on said plate and being operable by depressing and rotation movements, said rotation/depression knob being positioned adjacent said depression knob and having a shaft portion, said shaft portion having an outer peripheral portion formed with gear teeth and having a conical shape;

a rotation/depression switch for being turned on in response to rotation or depressing movement of said rotation/depression knob; and a coupling plate disposed slidable between said depression knob and said rotation/depression knob, said plate having one end provided with a pawl portion which is engageable with said gear teeth portion of said shaft of said rotation/depression knob and having another end formed with a locking portion engagable with said locking step of said shaft portion of said depression knob, said coupling plate further being provided such that when said rotation/depression knob is rotated or depressed, said coupling plate is slidably movable by being pushed by said shaft portion, and at the same time, said locking step of said depression knob is disengaged from said locking portion of said coupling plate so that said depression knob and switch are automatically returned to its OFF state.

5. A switching device comprising:

a depression knob projecting from a plate and being operable by depressing movement;

a depression switch which is turned ON in response to depressing operation of said depression knob;

a rotation/depression knob projecting from said plate and being operable by rotation and depressing movement;

a release switch which turns said depression switch OFF upon On operation of said release switch;

a central shaft connected to said rotation/depression switch knob; and a release plate having one end fixed to said central shaft and another end provided abuttable with said release switch for transmitting depressing movement of said rotation/depression switch knob and turning ON said release switch.

* * * * *